US012447520B2

(12) United States Patent
Thome et al.

(10) Patent No.: US 12,447,520 B2
(45) Date of Patent: Oct. 21, 2025

(54) METHOD FOR PRODUCING OPEN-SEAM PIPES

(71) Applicant: SMS group GmbH, Düsseldorf (DE)

(72) Inventors: Mario Thome, Willich (DE); Regine Ahrem, Wuppertal (DE); Jochen Vochsen, Erkelenz (DE)

(73) Assignee: SMS group GmbH, Düsseldorf (DE)

( * ) Notice: Subject to any disclaimer, the term of this patent is extended or adjusted under 35 U.S.C. 154(b) by 137 days.

(21) Appl. No.: 18/039,341

(22) PCT Filed: Nov. 8, 2021

(86) PCT No.: PCT/EP2021/080968

§ 371 (c)(1),
(2) Date: May 30, 2023

(87) PCT Pub. No.: WO2022/117287

PCT Pub. Date: Jun. 9, 2022

(65) Prior Publication Data

US 2023/0415213 A1 Dec. 28, 2023

(30) Foreign Application Priority Data

Dec. 1, 2020 (DE) ..... 10 2020 215 088.5

(51) Int. Cl.
*B21D 5/01* (2006.01)
*B21C 37/08* (2006.01)

(52) U.S. Cl.
CPC ..... *B21D 5/015* (2013.01); *B21C 37/0815* (2013.01)

(58) Field of Classification Search
CPC . B21C 37/0815; B21C 37/08; B21C 37/0822; B21D 5/015; B21D 5/01; B21D 5/10
See application file for complete search history.

(56) References Cited

FOREIGN PATENT DOCUMENTS

| | | | |
|---|---|---|---|
| CN | 110102607 | A | 8/2019 |
| DE | 102011009660 | A1 | 8/2012 |
| EP | 3000542 | A1 | 3/2016 |

(Continued)

OTHER PUBLICATIONS

M. Thome, S. Zeller, "ShapeControl—assistance in pipe production," METEC & 4th ESTAD (European Steel Technology and Application Days) Jun. 24-28, 2019, Dusseldorf, Germany.

(Continued)

*Primary Examiner* — Debra M Sullivan
(74) *Attorney, Agent, or Firm* — Smartpat PLC

(57) ABSTRACT

A method for producing open-seam pipes from flat metal products, in particular sheet metal, includes a plurality of individual bending steps using at least one bending tool and at least one externally located lower tool. A plurality of positions of individual bending steps and the insertion depth of the bending tool are calculated in advance. Based thereon the flat metal product is then shaped step-by-step to form the open-seam pipe. After each of the bending steps, a target/actual comparison of the distance between two edges and/or between one of the two edges and the axial center line of the flat metal product is carried out. In case of a deviation, a correction value for the subsequent bending step is determined using a correction algorithm so as then to adapt the insertion depth for the bending tool.

10 Claims, 3 Drawing Sheets

(56) References Cited

FOREIGN PATENT DOCUMENTS

| | | | | |
|---|---|---|---|---|
| EP | 3006128 | A1 * | 4/2016 | ..... B21C 37/0815 |
| JP | 6028931 | B2 | 11/2016 | |
| WO | WO-2012092909 | A1 * | 7/2012 | ..... B21D 11/203 |

OTHER PUBLICATIONS

Mario Thome, Berthold Genser, Shape—A "thinking" forming press, https://www.sms-group.com/en-de/insights/all-insights/shape-a-thinking-forming-press, Feb. 21, 2018.

Thome, Mario, and Susanne Zeller. "On course to smart large-diameter pipe production." Procedia Manufacturing 29 (2019): 544-551.

Thome, Mario, Jochen Vochsen, and Vasileios Gotsis. "Calculation tool and closed loop control for the JCO® pipe forming process." Procedia engineering 207 (2017): 1605-1610.

Mario Thome et al., "Method for pre-shaping sheet metal, and computer program and device for carrying out the method", co-pending U.S. Appl. No. 18/039,371.

* cited by examiner

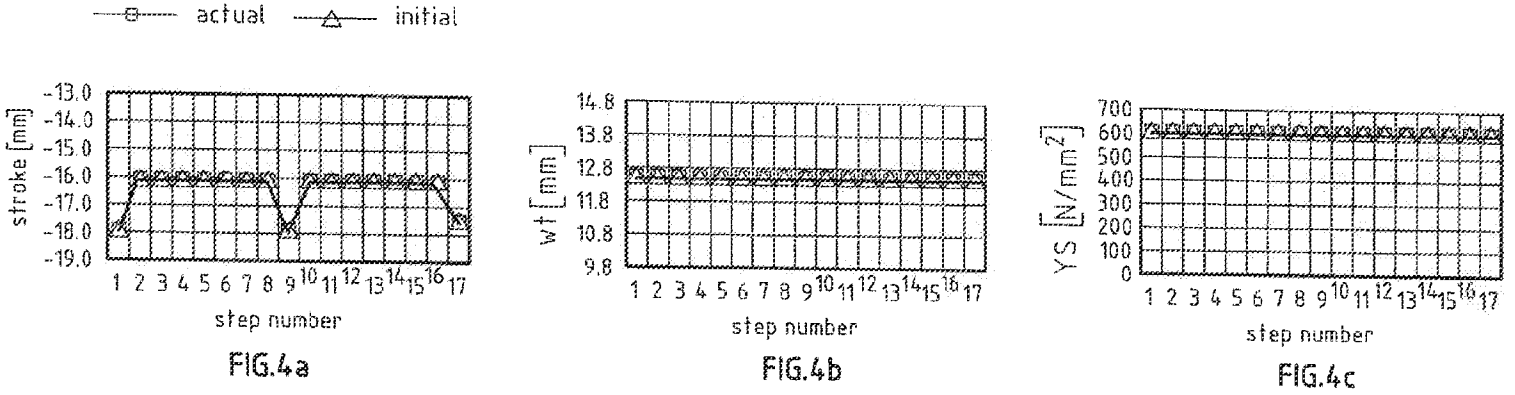
FIG.4a FIG.4b FIG.4c
FIG.4
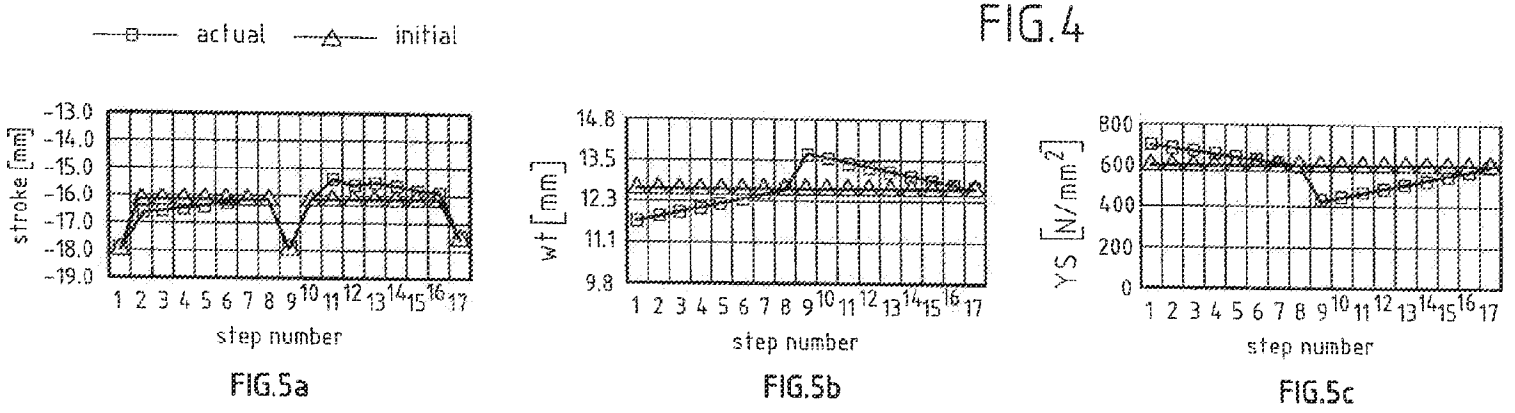
FIG.5a FIG.5b FIG.5c
FIG.5

METHOD FOR PRODUCING OPEN-SEAM PIPES

CROSS-REFERENCE TO RELATED APPLICATION

This application is a national stage application, filed under 35 U.S.C. § 371, of International Patent Application PCT/EP2021/080968, filed on Nov. 8, 2021, which claims the benefit of German Patent Application DE 10 2020 215 088.5 filed on Dec. 1, 2020.

TECHNICAL FIELD

The present disclosure relates to a method for producing open-seam pipes by shaping flat metal products, in particular sheet metal, by shaping them in a step-by-step manner in the circumferential direction of the open-seam pipe being created in a plurality of individual bending steps using at least one bending tool and at least one external lower tool, and to an open-seam pipe produced by the method.

BACKGROUND

The production of thick-walled pipes, for example for pipeline applications or the like, is typically carried out by in a step-by-step manner shaping of flat products into a so-called open-seam pipe by firstly shaping the flat product over its entire length into the open-seam pipe, also known as preliminary pipe product, and then welding it by inserting a longitudinal seam.

As a rule, the shaping of the flat product takes place in two steps, wherein a first shaping results in a preliminary pipe product with a polygon-like contour. An almost circular contour of the cross-section is then achieved in a second step using an expander. However, with thick-walled pipes, there is then a risk of overloading the expander tools.

Using the bending tool and two counter bearings or lower tools, for example in the form of lower beams, the flat product is locally shaped in the above-mentioned first shaping step and the ultimately desired shape of the workpiece is obtained through the succession of many such shaping operations.

This shaping is typically based on empirical values and a mathematical consideration of these. Since the respective flat metal products have locally different strengths and thus correspondingly different shaping behavior, industrial fabrication of such open-seam pipes represents an extremely complex process due to the various disturbance variables, such as sheet thickness and batch fluctuations.

As such, there is a continuing desire in the industry to automate such complex shaping processes in order to be able to produce pipe cross-sections with as little deviation as possible from the desired contour, preferably roundness of the cross-section, along with a desired shape over the entire length.

A device and a method for shaping flat products into open-seam pipes or preliminary pipe products is known, for example, from DE 10 2011 009 660 A1. The device comprises at least one internal shaping tool for at least in a step-by-step manner shaping of the flat product in the circumferential direction of the cross-section of the open-seam pipe or preliminary pipe product being created, and at least one external shaping tool for shaping the flat product from the outside, wherein at least one light source and at least one receiver for measuring at least the internal contour of the open-seam pipe or preliminary pipe product are connected to at least one internal shaping tool. By continuously tracking the results from contour measurements of individual shaping steps, such a device allows efficient process control and controlled shaping of the starting materials into the open-seam pipes with defined contours or shapes in such a manner that deviations can be compensated much faster and more accurately and the shaped sheet metal structures can be produced much more reliably and accurately. However, this type of control requires knowledge of the current pipe contour, which is detected via the light measurement systems. These have to be accommodated in the respective tools in a complex manner.

Furthermore, Chinese patent application CN 110102607 A discloses a method for producing open-seam pipes with the so-called "JCO process." With this method, a sequence of bending steps is determined for a pipe, wherein each individual step of the plurality of bending steps is repeated several times starting from a "safe" insertion depth until a previously calculated distance from the center of the step to a point near the edge is reached or until the measuring bridge used indicates a radius calculated in advance. All subsequent open-seam pipes are then produced on the basis of such sequence.

SUMMARY

It is the object of the present disclosure to provide an improved process for producing open-seam pipes compared to the prior art, in particular to provide a method for producing open-seam pipes that allows control over the entire circumference.

In accordance with the invention, the object is achieved by a method as claimed.

In accordance with the method for producing open-seam pipes from flat metal products, in particular sheet metal, it is provided that these are shaped in a step-by-step manner in the circumferential direction of the open-seam pipe being created in a plurality of individual bending steps using at least one bending tool and at least one external lower tool; wherein firstly a plurality of positions of individual bending steps and the insertion depth of the bending tool are calculated in advance and on the basis of this advance calculation the flat metal product is then shaped in a step-by-step manner to form the open-seam pipe.

The method is characterized in that, after each of the plurality of bending steps, a target/actual comparison of the distance between two edges is carried out at at least one position arranged along the longitudinal extent of the flat metal product and/or between one of the two edges and the axial center line of the flat metal product, and in the event of a deviation, a correction value for the subsequent bending step is determined using a correction algorithm so as then to adapt the insertion depth for the bending tool.

In accordance with the method, the entire inner contour or an inner contour section is not detected, as is usual in the prior art, but the behavior of the edges of the flat metal product is controlled in a step-by-step manner during the forming process to form the open-seam pipe by determining the edge distance of two edges and/or the distance between one of the two edges and the axial center line of the flat metal product after each of the plurality of bending steps. For this purpose, a laser sensor system with a laser source and a laser detector and/or a computer-assisted camera, which carries out the distance measurement via a suitable evaluation program, can advantageously be used. As a supplement or alternative, the edge distance of two edges and/or the distance between one of the two edges and the axial center line of the flat metal product can be determined by ultrasound after each of the plurality of bending steps. By calculating in advance the plurality of positions of the individual bending steps along with the respective required insertion depths, the target distance values for the entire forming process can be determined. In the event of a deviation, a correction value for the subsequent bending step can be determined using a correction algorithm on the basis of such target and the then determined actual positions, so as then to adapt the required insertion depth for the bending tool. A further advantage of the method is that the correction can already be made after the first bending step, which is carried out using the bending tool, and thus, compared to the methods known from the prior art, one step earlier. As a whole, this enables step-by-step real-time control, which ensures particularly high contour accuracy over the entire circumference. The high degree of contour accuracy has a particularly beneficial effect on ovality, which can be kept within a particularly narrow parameter window as a result of the continuous process control.

As a result of the fact that contour accuracy is now possible over the entire circumference of the open-seam pipe, the expander tools can be loaded more uniformly, in particular in the case of thick-walled pipes with wall thicknesses of at least 6.0 mm, preferably at least 15.0 mm, more preferably at least 20.0 mm or more, such that the risk of overloading them is reduced.

Moreover, on the basis of the high degree of contour accuracy over the entire circumference, no repetition of the individual bending steps is required. As such, advantageously, it is provided that each of the plurality of bending steps is carried out only one time. This allows particularly high cycle times during fabrication.

Further advantageous embodiments of the invention are indicated in the dependent formulated claims. The features listed individually in the dependent formulated claims can be combined with one another in a technologically useful manner and may define further embodiments of the invention. In addition, the features indicated in the claims are further specified and explained in the description, wherein further preferred embodiments of the invention are illustrated.

For the purposes of the present disclosure, the term "edge" is understood to mean an end face of the flat metal product that extends along the longitudinal extent of the flat metal product.

In principle, the at least one edge, preferably two edges, of the flat metal product can be formed as a straight edge, which is understood to mean an end face formed perpendicular to one of the two lateral surfaces of the flat metal product. Such an edge then has two edge points that can be detected by sensors.

However, in an advantageous embodiment, it is provided that the at least one, more preferably two edges, of the flat metal product has a geometry that is optimized for the subsequent welding process and comprises two, three or n partial end faces, wherein two mutually adjacent partial end faces enclose an angle in each case. An edge formed in this manner then has at least three, four, or n edge points, which can be detected by sensors in order to determine the distances between the two edges and/or between one of the two edges and the axial center line of the flat metal product. Which of the edge points are then viewed in relation to each other can vary from step to step depending on the accessibility or detectability of these by a laser sensor system and/or a computer-assisted camera unit.

The present method is suitable for a particularly wide range of production. As such, advantageously, the flat metal products have a width of 0.2 to 10 m, more preferably a width of 0.8 to 8 m, and most preferably a width of 1.0 to 6.0 m, and a thickness of 5.0 to 100 mm, more preferably a thickness of 6.0 to 50 mm.

For the purposes of the present disclosure, the term "width" is understood to mean the radial extent of the flat metallic product along which the open-seam pipe being created is formed by the plurality of bending steps.

In a preferred embodiment, the target/actual comparison of the distance is performed at at least two, more preferably at least three, even more preferably at a plurality of positions arranged along the longitudinal extent of the flat metal product between the two edges and/or between one of the two edges and the axial center line of the flat metal product, such that independent control is made possible section by section over the axial length of the open-seam pipe being created.

Advantageously, it is provided that the measurement results of the actual value distance between the two edges and/or between one of the two edges and the axial center line of the flat metal product are transmitted to a control unit, which then carries out the target/actual comparison of the distance and, in the event of a deviation, determines a correction value for the subsequent bending step using the correction algorithm, by which the control unit controls and regulates a fully automatic shaping of the flat metal product into the open-seam pipe.

Particularly advantageously, the actual value distance between the two edges and/or one of the two edges and the axial center line is carried out by a laser sensor system and/or a computer-assisted camera unit, which is particularly preferably connected to the control unit in terms of signal technology.

In a further aspect, the present invention further relates to an open-seam pipe.

The invention and the technical environment are explained in more detail below with reference to figures and examples. It should be noted that the invention is not intended to be limited by the exemplary embodiments shown. In particular, unless explicitly shown otherwise, it is also possible to extract partial aspects of the facts explained in the figures and/or examples and combine them with other components and findings from the present description and/or figures. In particular, it should be noted that the figures or the examples, as the case may be, and in particular the size relationships shown are only schematic. Identical reference signs designate identical objects, such that explanations from other figures may be used as a supplement if necessary.

BRIEF DESCRIPTION OF THE DRAWINGS

FIGS. 4*a* to 4*c* show geometric results under ideal conditions for a sheet with a given wall thickness and a given yield strength under the assumption that these are constant, and FIGS. 5*a* to 5*c* show results from a first practical example.

DETAILED DESCRIPTION

Figure 1:
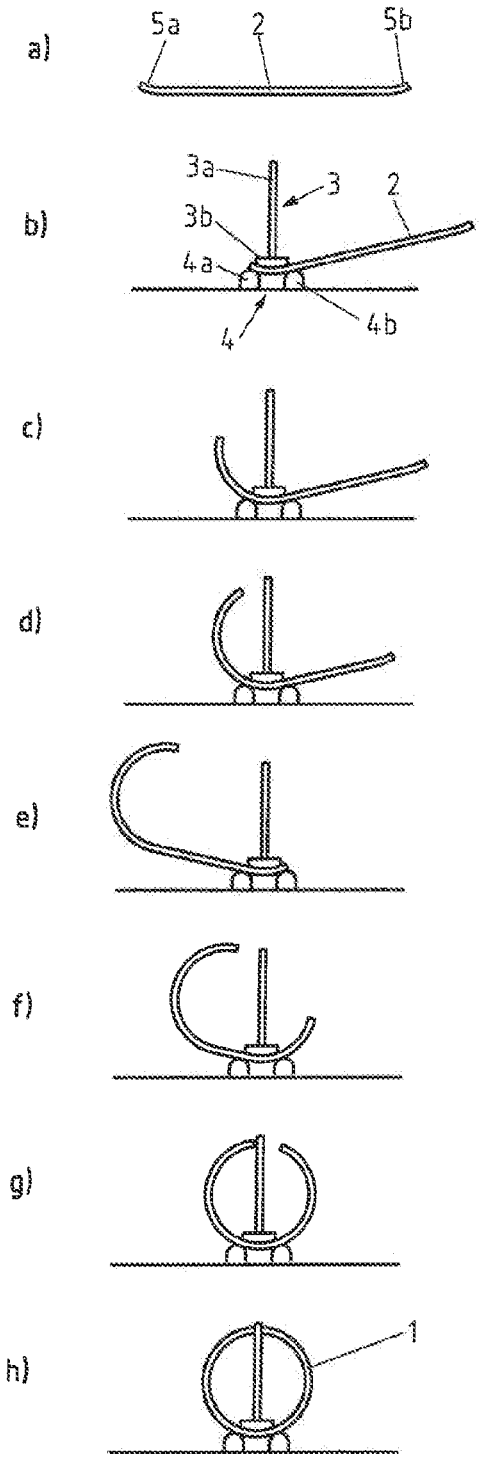
FIGS. 1*a* to 1*h* show an illustration of individual working steps in a shaping process for producing an open-seam pipe.

With reference to FIGS. 1*a* to 1*h*, the basic principle for producing an open-seam pipe 1 from a flat metal product 2 is shown on the basis of eight individual working or bending steps. The flat metal product 2 is shaped in a step-by-step manner in the circumferential direction of the open-seam pipe 1 being created by a plurality of individual bending steps using at least one bending tool 3 and two external lower tools 4.

In step a), the flat product 2 is shown with edge regions 5*a*, 5*b* already pre-shaped. The edge regions 5*a*, 5*b* are usually shaped in advance using a shaping press not shown. As step b) shows, the shaping process starts by threading the flat metal product 2 between two counter bearings 4*a*, 4*b* of the lower tool 4 and the bending tool 3, which comprises a shank 3*a* and a bending punch 3*b*. The bending tool 3 can be displaced stroke-by-stroke in a substantially perpendicular manner to the flat product 2 between the two counter bearings 4*a*, 4*b*. In the interaction of the counter bearings 4*a*, 4*b* along with the bending punch 3*b*, the introduction of local shaping into the flat product 2 then takes place. While in the working steps a) to d), the shaping of the first side of the flat product 2 into an open-seam pipe cross-section takes place, in steps e) to h), the step-by-step shaping of the right side of the flat product 2 to form the open-seam pipe 1 is illustrated. Both shaping processes are usually carried out as a sequence of a plurality of local shaping steps from the side edges 5*a*, 5*b* inwards.

Figure 2:
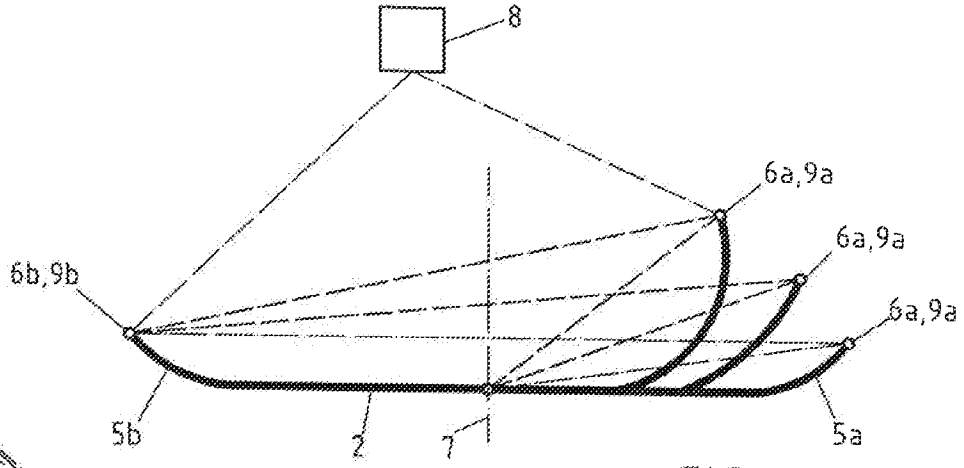
FIG. 2 shows the measuring principle in a first embodiment.

FIG. 2 shows a variant of the measuring principle. As can be seen from the illustration, after each of the bending steps carried out, as shown in FIG. 1, a measurement is made via a laser sensor system 8 to determine the actual distance between the two edges 6*a*, 6*b* and/or between one of the two edges 6*a* and the axial center line 7 of the flat metal product 2. Thereby, the laser sensor system 8 detects a detectable edge point 9*a*, 9*b* of the respective edge 6*a*, 6*b*.

Figure 3:
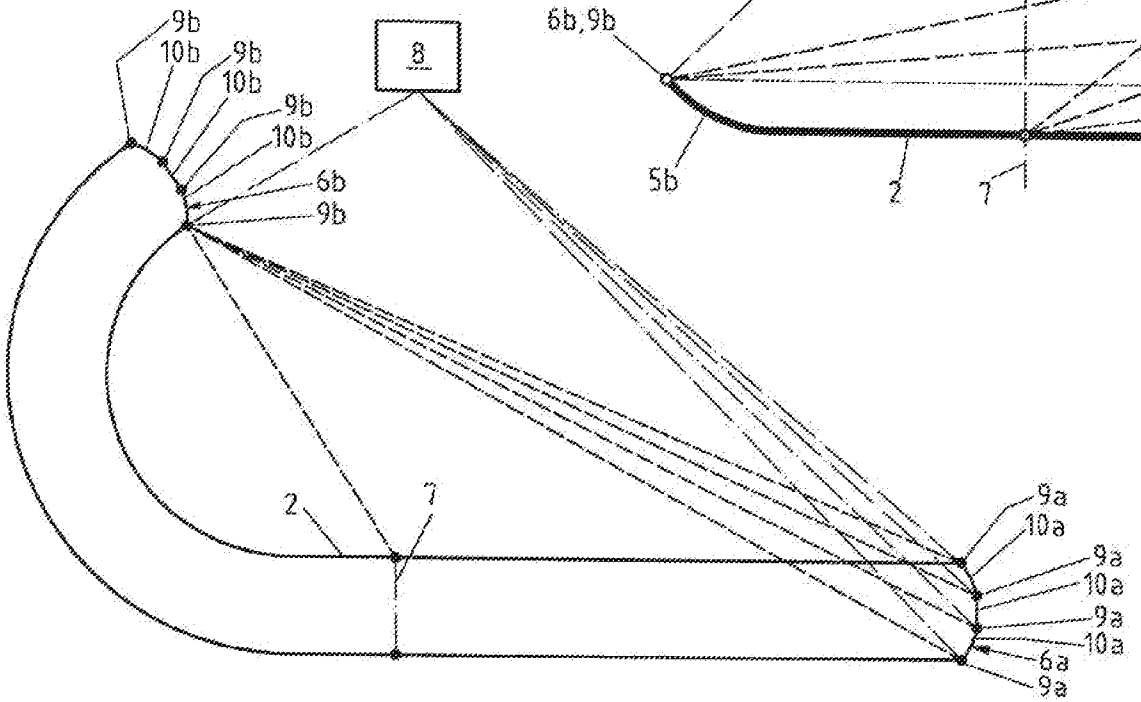
FIG. 3 shows the measuring principle in a second embodiment.

FIG. 3 shows a further variant of the measuring principle. In contrast to the first embodiment, each of the edges 6*a*, 6*b* of the flat metal product has a plurality of partial end faces 10*a*, 10*b*. As can be seen from the illustration, two mutually adjacent partial end faces 10*a*, 10*b* each enclose an angle and each form an edge point 9*a*, 9*b*, which can be detected by the laser sensor system 8 in order to determine the actual distance between two edges 6*a*, 6*b* and/or between one of the two edges 6*a* and the axial center line 7 of the flat metal product 2.

EXAMPLES

Comparative Example

To produce an open-seam pipe with an outer diameter of 813 mm, a wall thickness of 12.7 mm and a length of 10 m, a sheet with the dimensions (L×W×H) 10000×2554×12.7 mm, which had a yield strength of 600 MPa, was provided. A universal bending punch with a radius of 120 mm was used as the bending punch.

On the basis of the dimensions, the yield strength of the material, the radius of the bending punch used along with the lower tools, the lower tool distance and the E-modulus parameters, the number of individual bending steps and the corresponding insertion depths (FIG. 4*a*) were calculated in advance. For an open-seam pipe with a target slit width of 200.3 mm, 17 bending steps were determined.

Then, the edge regions were firstly formed using a shaping press in the conventional manner. The sheet was then threaded between the bending tool and the lower tool with two counter bearings, whereupon the individual bending steps 1 to 17 were carried out as calculated (FIG. 3*a*). Since the sheet is not ideal over the area in terms of material thickness and in terms of its yield strength, as assumed in the advance calculation, the entire shaping process in the comparative example resulted in a deviation of more than 3% in the slit width.

Example

In contrast to the comparative example, a target/actual comparison of the distance was already carried out after the first bending step, which was carried out on the basis of the insertion depth calculated in advance of 18 mm (see FIG. 5*a*). For this purpose, the distance between the two edge points 9*a*, 9*b* and additionally between the edge point 9*a* and the center line 7 was determined using the laser sensor system, as shown in FIGS. 2 and 3. The determined distances were compared with the previously calculated target distances, whereupon a correction value for the subsequent second bending step was determined using a correction algorithm (see FIG. 5*a*). The insertion depth of the second bending step was then adjusted by the correction value, as shown in FIG. 5*a*. The subsequent bending steps 3 to 17 were carried out in the same manner.

Table 1 below shows the results from the comparative example and the example in accordance with the disclosure against the background of the theoretically calculated values. As can be seen from Table 1, the positive influence of the method in accordance with the disclosure on the contour of the open-seam pipe can be clearly seen.

TABLE 1

| | Calculated | Comparative example | Example |
|---|---|---|---|
| Slit width | 200.3 | 207.2 | 201 |
| Distance 1 | 861 | 888 | 866 |
| Distance 2 | 861 | 833 | 853 |

LIST OF REFERENCE SIGNS

1 Open-seam pipe
2 Flat product
3 Bending tool
3*a* Shank
3*b* Bending punch
4 Lower tool
4*a* Counter bearing
4*b* Counter bearing
5*a* Edge region
5*b* Edge region
6*a* Edge
6*b* Edge
7 Center line
8 Laser sensor system
9*a* Edge point
9*b* Edge point
10*a* Partial end faces
10*b* Partial end faces

The invention claimed is:

1. A method for producing an open-seam pipe (1) from a flat metal product (2) with a bending tool (3) and at least one externally located lower tool (4), the method comprising:

calculating, in advance, a plurality of positions of individual bending steps and an insertion depth of the bending tool (3);

bending the flat metal product (2) step-by-step to form the open-seam pipe (1) based on the advance calculation by bringing together two longitudinal edges (6*a*, 6*b*) of the flat metal product (2);

carrying out, after each of the individual bending steps, a target/actual comparison of a distance between the two longitudinal edges (6*a*, 6*b*) at at least one position arranged along a longitudinal extent of the flat metal product (2) and/or between one of the two longitudinal edges (6*a*) and an axial center line (7) of the flat metal product (2); and determining, in an event of a deviation, a correction value for a subsequent bending step using a correction algorithm and adapting the insertion depth for the bending tool (3), wherein at least one of the two longitudinal edges (6*a*, 6*b*) comprises at least three edge points (9*a*, 9*b*) on a basis of which the target/actual comparison of the distance is carried out, and wherein the at least three edge points (9*a*, 9*b*) are spaced apart across a thickness of the at least one of the two longitudinal edges (6*a*, 6*b*).

2. The method according to claim 1, wherein the at least one of the two longitudinal edges (6*a*, 6*b*) has at least four edge points (9*a*, 9*b*) on a basis of which the target/actual comparison of the distance is carried out.

3. The method according to claim 1, wherein the at least one of the two longitudinal edges (6*a*, 6*b*) has more than four edge points (9*a*, 9*b*) on a basis of which the target/actual comparison of the distance is carried out.

4. The method according to claim 1, wherein the target/actual comparison of the distance is performed at at least two positions arranged along the longitudinal extent of the flat metal product (2) between the two longitudinal edges (6*a*, 6*b*) and/or between one of the two longitudinal edges (6*a*) and the axial center line (7) of the flat metal product (2).

5. The method according to claim 1, wherein the target/actual comparison of the distance is performed at at least three positions arranged along the longitudinal extent of the flat metal product (2) between the two longitudinal edges (6*a*, 6*b*) and/or between one of the two longitudinal edges (6*a*) and the axial center line (7) of the flat metal product (2).

6. The method according to claim 1, wherein the target/actual comparison of the distance is performed at more than three positions arranged along the longitudinal extent of the flat metal product (2) between the two longitudinal edges (6*a*, 6*b*) and/or between one of the two longitudinal edges (6*a*) and the axial center line (7) of the flat metal product (2).

7. The method according to claim 1, wherein measurement results of actual distances between the two longitudinal edges (6*a*, 6*b*) and/or between one of the two longitudinal edges (6*a*) and the axial center line (7) of the flat metal product (2) are transmitted to a control unit, which then carries out the target/actual comparison of the distance and, in the event of the deviation, determines the correction value for the subsequent bending step using the correction algorithm, by which the control unit controls and regulates a fully automatic bending of the flat metal product into the open-seam pipe (1).

8. The method according to claim 1, wherein the actual distance between the two longitudinal edges (6*a*, 6*b*) and/or one of the two longitudinal edges (6*a*) and the axial center line (7) is measured by a laser sensor system (8) and/or a computer-assisted camera.

9. The method according to claim 1, wherein each of the plurality of bending steps is carried out only one time.

10. The method according to claim 1, wherein the flat metal product (2) has a width of 0.2 to 10 m and a thickness of 6.0 to 100 mm.

* * * * *